US011156117B2

(12) United States Patent
Lewis

(10) Patent No.: US 11,156,117 B2
(45) Date of Patent: Oct. 26, 2021

(54) SEAL ARC SEGMENT WITH SLOPED CIRCUMFERENTIAL SIDES

(71) Applicant: United Technologies Corporation, Farmington, CT (US)

(72) Inventor: Scott D. Lewis, Vernon, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 590 days.

(21) Appl. No.: 15/137,044

(22) Filed: Apr. 25, 2016

(65) Prior Publication Data

US 2017/0306781 A1 Oct. 26, 2017

(51) Int. Cl.

| | |
|---|---|
| ***F01D 11/08*** | (2006.01) |
| ***F01D 11/00*** | (2006.01) |
| ***F01D 11/04*** | (2006.01) |
| ***F01D 11/24*** | (2006.01) |
| ***F01D 5/02*** | (2006.01) |
| ***F01D 5/12*** | (2006.01) |
| ***F01D 25/12*** | (2006.01) |

(52) U.S. Cl.

CPC ..... *F01D 11/08* (2013.01); *F01D 5/02* (2013.01); *F01D 5/12* (2013.01); *F01D 11/005* (2013.01); *F01D 11/04* (2013.01); *F01D 11/24* (2013.01); *F01D 25/12* (2013.01); *F05D 2220/32* (2013.01); *F05D 2240/11* (2013.01)

(58) Field of Classification Search

CPC ... F01D 11/08; F01D 5/02; F01D 5/12; F01D 11/02

See application file for complete search history.

(56) References Cited

U.S. PATENT DOCUMENTS 5,374,161 A * 12/1994 Kelch ..... F01D 11/005 277/641
6,261,053 B1 * 7/2001 Anderson ..... F01D 5/08 415/115
6,533,542 B2 * 3/2003 Sugishita ..... F01D 5/145 415/139
8,287,234 B1 10/2012 Liang (Continued)

FOREIGN PATENT DOCUMENTS

EP 1519010 3/2005
EP 2987959 2/2016

(Continued)

OTHER PUBLICATIONS

European Search Report for European Patent Application No. 17167642 completed Sep. 5, 2017.

*Primary Examiner* — Michael L Sehn

(74) *Attorney, Agent, or Firm* — Carlson, Gaskey & Olds, P.C.

(57) ABSTRACT

A seal for a gas turbine engine includes a plurality of seal arc segments. Each of the seal arc segments includes radially inner and outer sides and sloped first and second circumferential sides. The seal arc segments are circumferentially arranged about an axis such that the sloped first and second circumferential sides define gaps circumferentially between adjacent ones of the seal arc segments. Each of the gaps extends from the radially inner sides along a respective central gap axis that slopes with respect to a radial direction from the axis.

20 Claims, 4 Drawing Sheets

(56) References Cited

U.S. PATENT DOCUMENTS

| | | | | |
|---|---|---|---|---|
| 8,585,354 | B1 * | 11/2013 | Liang | F01D 11/008 415/135 |
| 2005/0067788 | A1 * | 3/2005 | Liang | F01D 11/005 277/409 |
| 2016/0047250 | A1 | 2/2016 | Lewis | |

FOREIGN PATENT DOCUMENTS

| | | |
|---|---|---|
| FR | 2961849 | 12/2011 |
| GB | 2356022 | 5/2001 |
| WO | 2015034697 | 3/2015 |

* cited by examiner

SEAL ARC SEGMENT WITH SLOPED CIRCUMFERENTIAL SIDES

BACKGROUND

A gas turbine engine typically includes at least a compressor section, a combustor section and a turbine section. The compressor section pressurizes air into the combustion section where the air is mixed with fuel and ignited to generate an exhaust gas flow. The exhaust gas flow expands through the turbine section to drive the compressor section and, if the engine is designed for propulsion, a fan section.

The turbine section may include multiple stages of rotatable blades and static vanes. An annular shroud or blade outer air seal may be provided around the blades in close radial proximity to the tips of the blades to reduce the amount of gas flow that escapes around the blades. The shroud typically includes a plurality of arc segments that are circumferentially arranged. The arc segments may be abradable to reduce the radial gap with the tips of the blades.

SUMMARY

A seal for a gas turbine engine according to an example of the present disclosure includes a plurality of seal arc segments. Each of the seal arc segments includes radially inner and outer sides and sloped first and second circumferential sides. The seal arc segments are circumferentially arranged about an axis such that the sloped first and second circumferential sides define gaps circumferentially between adjacent ones of the seal arc segments. Each of the gaps extends from the radially inner side along a respective central gap axis that slopes with respect to a radial direction from the axis.

In a further embodiment of any of the foregoing embodiments, the central gap axis has an exterior angle $\alpha$ of 10°-80° with the radial direction.

In a further embodiment of any of the foregoing embodiments, at least one of the first and second circumferential sides includes a compound angle.

In a further embodiment of any of the foregoing embodiments, each of the gaps includes an elbow at which the slope of the central gap axis changes.

In a further embodiment of any of the foregoing embodiments, the central gap axis has an exterior angle $\beta$ of less than 80° with respect to a circumferential gas flow direction along the radially inner sides.

In a further embodiment of any of the foregoing embodiments, the slope of the central gap axis is congruent with a circumferential flow direction at the radially inner sides.

In a further embodiment of any of the foregoing embodiments, the gaps are substantially linear.

A gas turbine engine according to an example of the present disclosure includes a rotor section that has a rotor with a plurality of blades and at least one annular seal circumscribing the rotor. The annular seal includes a plurality of seal arc segments. Each of the seal arc segments includes radially inner and outer sides and sloped first and second circumferential sides. The seal arc segments are circumferentially arranged about an axis such that the sloped first and second circumferential sides define gaps circumferentially between adjacent ones of the seal arc segments. The gaps extend from the radially inner sides along a central gap axis that slopes with respect to a radial direction from the axis.

In a further embodiment of any of the foregoing embodiments, the central gap axis has an exterior angle $\alpha$ of 80°-10° with the radial direction.

In a further embodiment of any of the foregoing embodiments, at least one of the first and second circumferential sides includes a compound angle.

In a further embodiment of any of the foregoing embodiments, each of the gaps includes an elbow at which the slope of the central gap axis changes.

In a further embodiment of any of the foregoing embodiments, the central gap axis has an exterior angle $\beta$ of less than 80° with respect to a circumferential gas flow direction along the radially inner sides.

In a further embodiment of any of the foregoing embodiments, the slope of the central gap axis is congruent with a rotational direction of the rotor.

In a further embodiment of any of the foregoing embodiments, each of the seal arc segments include an internal cooling passage that opens at one of the sloped first and second circumferential sides.

A seal arc segment for a gas turbine engine according to an example of the present disclosure include a seal arc segment body defining radially inner and outer sides and sloped first and second circumferential sides that extend from the radially inner side.

In a further embodiment of any of the foregoing embodiments, at least one of the sloped first and second circumferential sides has an exterior angle $\theta$ of less than 80° with the radially inner side.

In a further embodiment of any of the foregoing embodiments, the seal arc segment body includes an internal cooling passage that opens at one of the sloped first and second circumferential sides.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
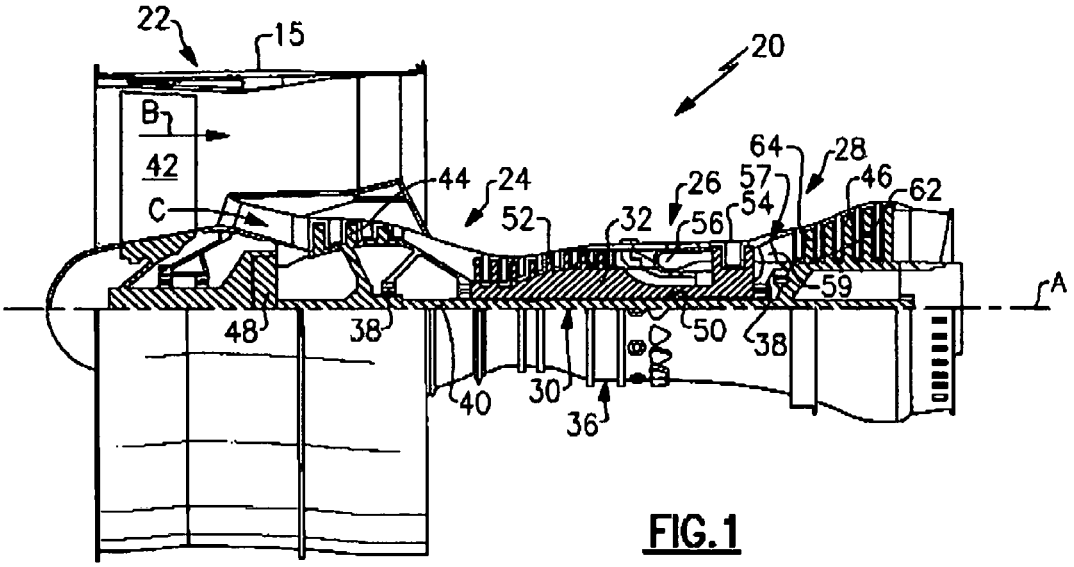
FIG. 1 illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engine designs can include an augmenter section (not shown) among other systems or features.

The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, the examples herein are not limited to use with two-spool turbofans and may be applied to other types of turbomachinery, including direct drive engine architectures, three-spool engine architectures, and ground-based turbines.

The engine 20 generally includes a low speed spool 30 and a high speed spool 32 mounted for rotation about an engine central axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48, to drive the fan 42 at a lower speed than the low speed spool 30.

The high speed spool 32 includes an outer shaft 50 that interconnects a second (or high) pressure compressor 52 and a second (or high) pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports the bearing systems 38 in the turbine section 28. The inner shaft 40 and the outer shaft 50 are concentric and rotate via bearing systems 38 about the engine central longitudinal axis A, which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines, including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

Figure 2A:
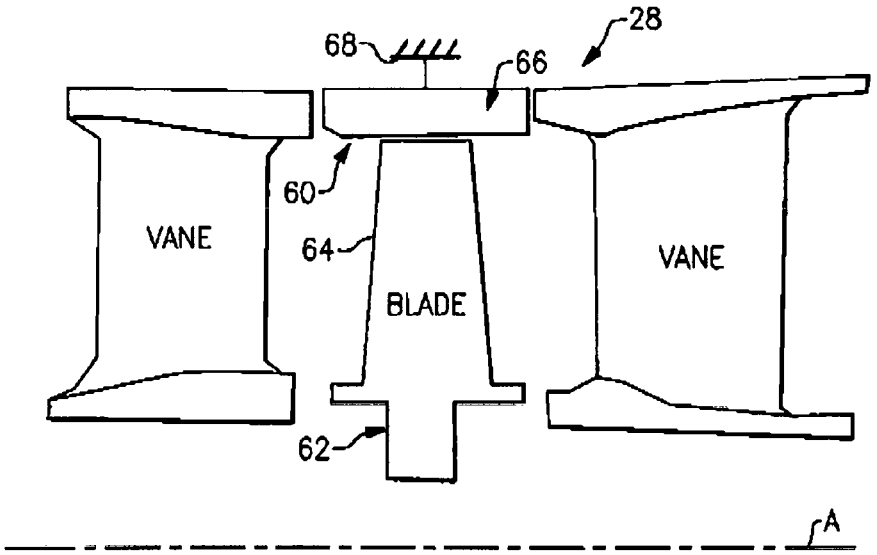
FIG. 2A illustrates a sectioned view along an engine central axis A of a portion of a turbine section.
Figure 2C:
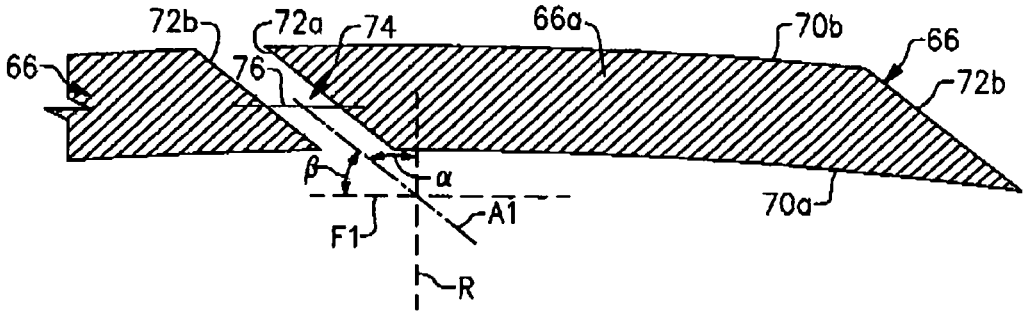
FIG. 2C illustrates adjacent seal arc segments of a blade outer air seal of a turbine section.
Figure 2B:
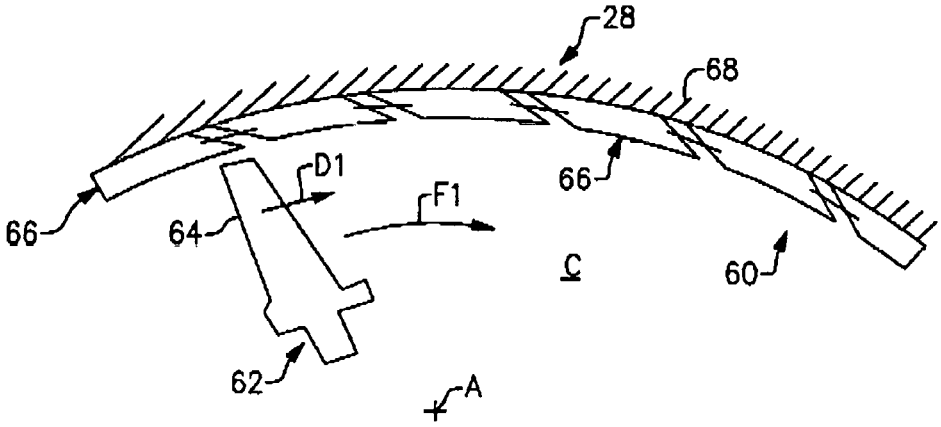
FIG. 2B illustrates an axial view of a portion of the turbine section.

FIG. 2A illustrates a sectioned view taken along the engine central axis A of a portion of the turbine section 28, and FIG. 2B illustrates an axial view of a portion of a turbine section 28. In this example, the turbine section 28 includes an annular blade outer air seal (BOAS) system or assembly 60 (hereafter BOAS 60) that is located radially outwards of a rotor 62 that has a row of rotor blades 64. As can be appreciated, the BOAS 60 can alternatively or additionally be adapted for other portions of the engine 20, such as the compressor section 24. The BOAS 60 includes a plurality of seal arc segments 66 that are circumferentially arranged in an annulus around the engine central axis A. Each of the seal arc segments 66 may be mounted in a known manner to a surrounding case structure 68. The BOAS 60 is in close radial proximity to the tips of the blades 64, to reduce the amount of gas flow that escapes around the blades 64.

FIG. 2C illustrates several adjacent representative ones of the seal arc segments 66. Each seal arc segment 66 includes a body 66*a* that can be formed of a metal alloy or ceramic material. The body 66*a* defines radially inner and outer sides 70*a*/70*b*. Although not shown, the radially outer sides 70*b* may include attachment features, such as hooks, for mounting the seal arc segments 66 to the case structure 68. The body 66*a* of each seal arc segment 66 also defines sloped first and second circumferential sides 72*a*/72*b*. The first and second circumferential sides 72*a*/72*b* are sloped with respect to a radial direction R from the engine central axis A.

The seal arc segments 66 are circumferentially arranged (FIG. 2B) about the engine central axis A such that the sloped first and second circumferential sides 72*a*/72*b* define gaps 74 circumferentially between adjacent ones of the seal arc segments 66. Since the first and second circumferential sides 72*a*/72*b* are sloped and substantially planar, the gaps 74 in this example are also sloped with respect to the radial direction R and are substantially linear. Alternatively, the sloped first and second circumferential sides 72*a*/72*b* may be curved such that the gaps 74 would also be curved. Seals 76 (one shown), such as feather seals, can be provided in each gap 74 between adjacent seal arc segments 66 to restrict escape of gas flow.

Each of the gaps 74 extends from the radially inner sides 70*a* along a respective central gap axis A1 that slopes with respect to the radial direction R. For example, the central gap axis A1 has an exterior angle α of 10°-80° with the radial direction R. An exterior angle as used herein is the acute angle outboard of the intersection of two lines. Here, the exterior angle α represents the degree of slope of the gaps 74. For instance, a low interior angle α (e.g., approaching 10°) represents a steep gap slope, while a high interior angle α (e.g., approaching 80°) represents a shallow gap slope.

As shown in FIG. 2B, the rotor 62 in this example is rotatable in a clockwise direction (aft of the BOAS 60, looking forward in the engine 20), represented at Dl. When rotating, the rotor 62 may induce a circumferentially directed flow of hot gases in the core gas path C, represented at flow direction F1. The central gap axis A1 has an exterior angle β of less than 80° with respect to flow direction F1 along the radially inner sides 70*a* of the seal arc segments. For instance, the local flow direction F1 at a given location at the radially inner sides 70*a* may generally be tangent to the circumference or curvature of the radially inner sides 70*a* of the seal arc segments 66. The slope of the central gap axis A1 is congruent with flow direction F1 at the radially inner sides 70*a*. That is, the gaps 74 open into the flow direction F1 rather than against the flow direction F1, which will be described in further detail below.

Figure 3:
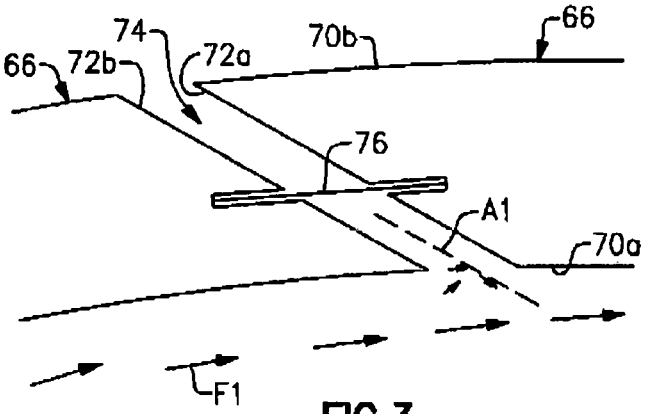
FIG. 3 illustrates how the orientation of a gap between adjacent seal arc segments influences gas flow penetration into the gap.

The orientation of the gaps 74 to open into the flow direction F1 facilitates the restriction of flow penetration of hot gases from the core gas path C into the gaps 74. For example, as shown in FIG. 3, the circumferential momentum of the hot gas carries the flow past the gaps 74 with limited flow penetration into the gaps 74. In order for the hot gases to penetrate, the flow must turn back on itself against its own momentum. Thus, the radial distance that the flow is able to penetrate into the gaps 74 is limited. In this regard, shallow gap slopes (i.e., interior angles α approaching 80°) will tend to have more restrictive flow penetration because the flow must turn back at a greater angle on itself against its own momentum. Steeper gap slopes (i.e., interior angles α approaching 10°) will tend to have less restrictive flow penetration because the flow must turn back at a lower angle on itself against its own momentum. Thus, interior angles α of 30°, 45°, 60°, and 80° would be expected to provide progressively more restrictive flow penetration.

Figure 4:
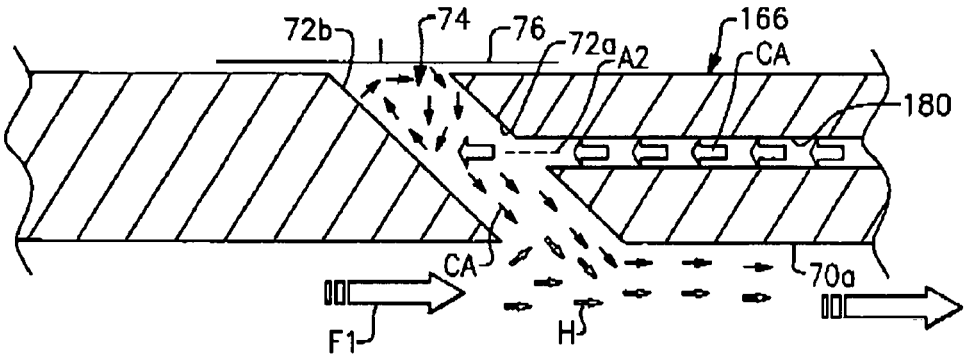
FIG. 4 illustrates another example of a seal arc segment with an internal cooling passage that opens into the gap.

FIG. 4 illustrates another example of a portion of a seal arc segment 166. In this disclosure, like reference numerals designate like elements where appropriate and reference numerals with the addition of one-hundred or multiples thereof designate modified elements that are understood to incorporate the same features and benefits of the corresponding elements. In this example, the seal arc segment 166 additionally includes an internal cooling passage 180. For instance, the cooling passage 180 may receive relative cool air CA from the compressor section 24 of the engine 20.

The cooling passage 180 extends along a central axis A2 and opens into the gap 74. The cooling passage 180 is thus oriented to jet cooling air into the gap 74 against the second circumferential side 72*b* of the adjacent seal arc segment 66. The slope of the second circumferential side 72*b* of the adjacent seal arc segment 66 deflects the cooling air radially outwards in the gap 74, which also causes the cooling air to lose velocity. The low velocity cooling air can then leak into the core gas path C as a film cooling flow along the radially inner side 70*a*. Thus, in addition to restricting flow penetration of the hot gases, represented by the different arrows at H, from the core gas path C into the gap 74, the sloped circumferential sides 72*a*/72*b* may also facilitate thermal management of the seal arc segments 66 in cooperation with the cooling passage 180.

Figure 5:
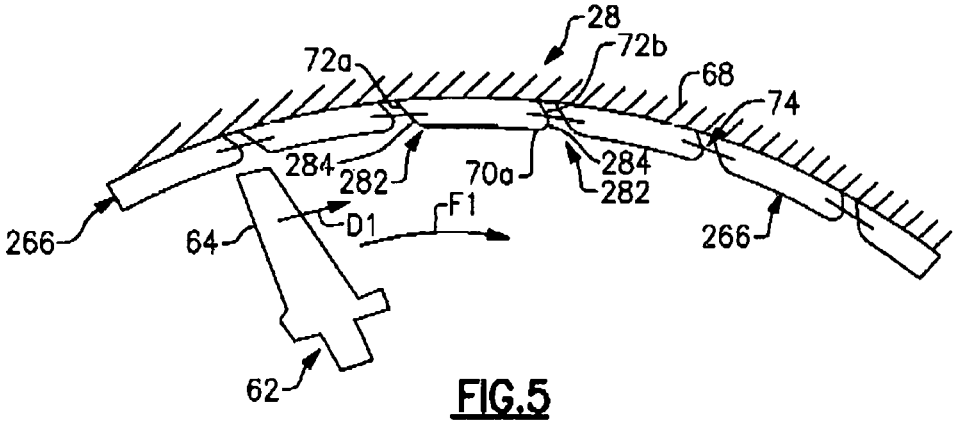
FIG. 5 illustrates another example of a seal arc segment that has circumferential sides with a compound angle.

FIG. 5 illustrates another example of a seal arc segment 266. In this example, each of the first and second circumferential sides 72*a*/72*b* includes a compound angle, represented at 282. In the illustrated example, the compound angle includes two angles. One of the angles is formed by a bevel or fillet surface 284 and the other of the angles is formed by the remainders of the first and second circumferential sides 72*a*/72*b*. The compound angle 282, and specifically the bevel or fillet surface 284, eliminates the sharp corner at the intersections of the first and second circumferential sides 72*a*/72*b* with the radially inner side 70*a*. As will be appreciated, in alternative examples, only one or the other of the first and second circumferential sides 72*a*/72*b* includes the compound angle. For instance, only the side 72*a* includes the bevel or fillet surface 284. The bevel or fillet surface 284 on the first circumferential side 72*a*, which in this example is immediately downstream of the gap 74, may serve to partially defect the flow of hot gases from the core gas path C back toward the core gas path C rather than into the gap 74. The defection back toward the core gas path C further facilitates the reduction in flow penetration into the gap 74. Additionally, the bevel or fillet surface 284 on the first circumferential side 72*a* may facilitate injection of cooling air from the mateface gap at a shallower radial angle to form a film of the cooling air and enhance cooling effectiveness.

Figure 6:
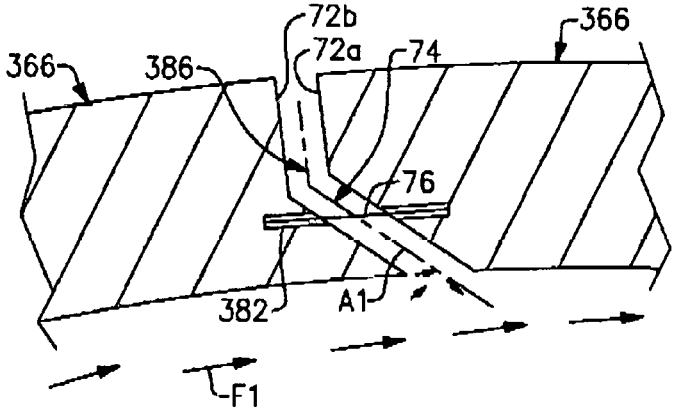
FIG. 6 illustrates another example of a seal arc segment that has circumferential sides with a compound angle such that the gap there between has an elbow.

FIG. 6 illustrates another example of a seal arc segment 366 with first and second circumferential sides 72*a*/72*b* that include a compound angle, represented at 382. In this example, rather than being proximal to the radially inner side 70*a*, the compound angle 382 is radially outboard of the seal 76 such that the gap 74 includes an elbow 386 at which the slope of the central gap axis A1 changes. For instance, radially outwards of the compound angle 382 the central gap axis A may have an exterior angle α of approximately 0° and radially inwards of the compound angle 382 the central gap axis A may have an exterior angle α of 10°-80° as discussed herein. The elbow 386 may facilitate sealing of the gap 74 by providing a change in direction for any flow that moves past the seal 76 and/or may facilitate fabrication of the seal arc segments 366 by reducing the amount of machining needed to form the slope of the first and second circumferential sides 72*a*/72*b*.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A seal for a gas turbine engine, comprising:

a plurality of seal arc segments, each of the plurality of seal arc segments including radially inner and outer sides and first and second circumferential sides, the plurality of seal arc segments being circumferentially arranged about a central axis such that the first and second circumferential sides define gaps circumferentially between adjacent ones of the plurality of seal arc segments, each of the gaps extending from the radially inner sides along a respective central gap axis, wherein each of the gaps includes an elbow at which the slope of the central gap axis changes from a first slope along a first portion of each gap that is radially inboard from the elbow to a second slope along a second portion of each gap that is radially outboard of the elbow, and wherein each of the seal arc segments includes an internal cooling passage that opens at the first slope of the first portion of each of the gaps, the internal cooling passage extending along a second axis parallel to the radially inner side, wherein the internal cooling passage is oriented to jet cooling air into each of the gaps against one of the first and second circumferential sides; and a feather seal extending across the first portion of each gap between adjacent ones of the plurality of seal arc segments.

2. The seal as recited in claim 1, wherein the central gap axis has an exterior angle $\alpha$ of 10°-80° with the radial direction.

3. The seal as recited in claim 1, wherein at least one of the first and second circumferential sides includes a compound angle.

4. The seal as recited in claim 1, wherein the central gap axis has an exterior angle $\beta$ of less than 80° with respect to a circumferential gas flow direction along the radially inner sides.

5. The seal as recited in claim 1, wherein the slope of the central gap axis is congruent with a circumferential flow direction at the radially inner sides along at least a portion of the central gap axis.

6. The seal as recited in claim 1, wherein the central gap axis is generally perpendicular to the radially inner and outer sides radially outboard from the elbow.

7. The seal as recited in claim 6, wherein the central gas axis is sloped with respect to a radial direction from the central axis radially inboard from the elbow.

8. A gas turbine engine comprising:

a rotor section including a rotor having a plurality of blades and at least one annular seal circumscribing the rotor, the annular seal comprising:

a plurality of seal arc segments, each of the plurality of seal arc segments including radially inner and outer sides and sloped first and second circumferential sides, the plurality of seal arc segments being circumferentially arranged about an engine axis such that the sloped first and second circumferential sides define gaps circumferentially between adjacent ones of the plurality of seal arc segments, the gaps extending from the radially inner sides along a central gap axis, wherein each of the gaps includes an elbow at which the slope of the central gap axis changes from a first slope along a first portion of each gap that is radially inboard from the elbow to a second slope along a second portion of each gap that is radially outboard of the elbow, and wherein each of the seal arc segments includes an internal cooling passage that opens at the first slope of the first portion of each of the gaps, the internal cooling passage extending along a second axis parallel to the radially inner side, wherein the internal cooling passage is oriented to jet cooling air into each of the gaps against one of the first and second circumferential sides; and a feather seal extending across the first portion of each gap between adjacent ones of the plurality of seal arc segments.

9. The gas turbine engine as recited in claim 8, wherein the central gap axis has an exterior angle $\alpha$ of 10°-80° with the radial direction.

10. The gas turbine engine as recited in claim 8, wherein at least one of the first and second circumferential sides includes a compound angle.

11. The gas turbine engine as recited in claim 8, wherein the central gap axis has an exterior angle $\beta$ of less than 80° with respect to a circumferential gas flow direction along the radially inner sides.

12. The gas turbine engine as recited in claim 8, wherein the slope of the central gap axis is congruent with a rotational direction of the rotor along at least a portion of the central gap axis.

13. The gas turbine engine as recited in claim 8, wherein each of the plurality of seal arc segments include an internal cooling passage that opens at one of the sloped first and second circumferential sides.

14. The gas turbine engine as recited in claim 8, wherein the feather seal restricts escape of gas flow around the plurality of blades.

15. The gas turbine engine as recited in claim 8, wherein the central gap axis is generally perpendicular to the engine axis radially outboard from the elbow.

16. The gas turbine engine as recited in claim 15, wherein the central gap axis is sloped with respect to a radial direction from the engine axis radially inboard from the elbow.

17. A seal arc segment for a gas turbine engine, comprising:

a seal arc segment body arranged with respect to an axis, the seal arc segment body defining radially inner and outer sides with respect to the axis and first and second circumferential sides extending from the radially inner side, the first and second circumferential sides each having a first portion sloped with respect to a radial direction from the axis and a second portion generally perpendicular to the radially inner and outer sides, wherein the seal arc segment body includes an internal cooling passage that opens at one of the first sloped portions of the first and second circumferential sides, the cooling passage extending along a second axis parallel to the radially inner side, wherein the internal cooling passage is oriented to jet cooling air into a gap against the other of the sloped first and second circumferential sides.

18. The seal arc segment as recited in claim 17, wherein at least one of the sloped first and second circumferential sides has an exterior angle $\beta$ of less than 80° with the radial direction.

19. The seal arc segment as recited in claim 17, where the internal cooling passage receives cooling air, and the cooling air flows in a direction opposite the circumferential gas flow direction.

20. The gas turbine engine as recited in claim 17, wherein the slope of the other of the sloped first and second circumferential sides deflects the cooling air radially outwards in the gap.

* * * * *